US006000566A

United States Patent [19]

Kost

[11] Patent Number: 6,000,566

[45] Date of Patent: Dec. 14, 1999

[54] TAMPER INDICATING BRIDGED FITMENT

[75] Inventor: Eric W. Kost, Evansville, Ind.

[73] Assignee: Rexam Plastics Inc., Evansville, Ind.

[21] Appl. No.: 09/004,018

[22] Filed: Jan. 7, 1998

[51] Int. Cl.[6] ..... B65D 1/02

[52] U.S. Cl. ..... 215/48; 215/54; 215/252; 215/355; 220/270

[58] Field of Search ..... 215/47, 48, 50, 215/54, 250, 252, 253, 258, 355, 364; 220/257, 266, 270; 229/125.09, 125.11; 222/541.1, 541.5, 541.6, 541.8

[56] References Cited

U.S. PATENT DOCUMENTS

| | | | |
|---|---|---|---|
| 725,687 | 4/1903 | Emerick | 215/250 |
| 734,801 | 7/1903 | Boisclaire | 215/54 |
| 818,984 | 4/1906 | Solatinow | 215/48 |
| 4,197,960 | 4/1980 | Walter . | |
| 4,420,076 | 12/1983 | Bereridge et al. . | |
| 4,664,279 | 5/1987 | Obrist et al. . | |
| 4,699,285 | 10/1987 | Perne et al. . | |
| 4,706,837 | 11/1987 | Cooke . | |
| 4,733,787 | 3/1988 | Knopf et al. | 215/251 |
| 4,830,273 | 5/1989 | Kalberer et al. | 229/123.1 |
| 4,871,077 | 10/1989 | Ogden et al. . | |
| 5,156,284 | 10/1992 | Rodriguez et al. . | |
| 5,174,465 | 12/1992 | Luch et al. . | |
| 5,303,837 | 4/1994 | Adams et al. . | |
| 5,579,932 | 12/1996 | Drozd et al. | 215/207 |
| 5,632,420 | 5/1997 | Lohrman et al. . | |

*Primary Examiner*—Stephen K. Cronin
*Attorney, Agent, or Firm*—Middleton & Reutlinger; John F. Salazar

[57] ABSTRACT

A tamper indicating bridged fitment is provided having an annular flange and an upwardly extending cylindrical side wall. Said fitment has a tamper indicating feature which is comprised of a bridge connected to the top edge of said upwardly extending cylindrical side wall by frangible webs. The tamper indicating bridge additionally has a slot formed longitudinally therethrough, said slot receiving a tab extending upward from a plug. The plug is a separate element which is comprised of a tab and a top wall and additionally has a downwardly extending cylindrical seal wall which acts to seal the fitment. Once the tab is inserted through the slot in the tamper indicating bridge, the fitment may only be opened by breaking the frangible tamper indicating webs connecting the bridge to the fitment side wall. Once the webs are broken, the plug may be removed by the tab and the bridge is thereby disconnected from the fitment. For reclosure of the fitment, the plug is inserted back into the fitment and is snugly fit therein preventing the contents of the container to which the fitment is attached from escaping.

17 Claims, 4 Drawing Sheets

TAMPER INDICATING BRIDGED FITMENT

BACKGROUND OF THE INVENTION

1. Field of the Invention

The present invention relates to a fitment which is applied to a container, typically a gabled top container made of a paperboard or pulp material, said tamper indicating bridged fitment of typical annular fitment formation but which includes a tamper indicating bridge across the spout.

2. Discussion of the Prior Art

Annular fitments for use with containers have been around for some time. Most annular fitments are comprised of an annular flange with a cylindrical wall extending upward therefrom defining the spout through which material flows from the container through the fitment. Most of these fitments are threaded fitments which receive a standard screw closure. For adaptation of the standard screw closure and fitment with a tamper indicating feature, it is usually the case that a pull tab or other pull ring feature is provided in the interior of the fitment for removal upon first use by the consumer. However, utilizing pull tabs or pull ring features in fitments requires excessive manufacturing steps which complicate the production of these fitments and the application of the fitments to the container as well as the addition. Further, the inclusion of a tamper indicating band on a standard screw closure adds a further manufacturing step which would preferably be left out so as to provide a single step manufacturing process for creation of a tamper indicating fitment. Tamper indicating bands are formed on the bottom annular edge of the side wall of the closure and upon first removal of the closure from the fitment, an inwardly directed bead contacts an outwardly directed bead on the fitment side wall thereby separating the tamper indicating band from the closure and providing a visual cue that the container has been previously opened.

There are no fitments in the prior art which provide a tamper indicating feature which provides visual cues as to the opening method and which provides a single manufacturing step for production of the tamper indicating fitment.

SUMMARY OF THE INVENTION

The present invention is for a fitment which is inserted or attached to a container and which has a tamper indicating feature. The tamper indicating bridged fitment of the present invention provides a solution to the drawbacks noted in the prior art. One object of the present invention is to provide a fitment which has a tamper indicating feature.

It is a further object of the present invention to provide a fitment with a tamper indicating feature and which is also resealable after use. An even further object of the present invention is to provide a fitment with a tamper indicating feature which provides a visual cue that the tamper indicating feature has been opened or broken by a prior user.

More particularly, an object of the present invention is to provide an annular fitment for application onto a container which has an annular flange for contacting and welding to the interior of the container, an upwardly extending cylindrical side wall which acts as the pouring spout for the fitment, a fitment plug which has an upwardly extending tab feature, a tamper indicating bridge through which extends said plug tab, and tamper indicating webs attaching said bridge to said cylindrical side wall of said fitment. Upon first use of the tamper indicating bridged fitment, the user twists the plug in a clockwise or counter clockwise direction and said plug, due to the frangible contacts of said tamper indicating bridge on the fitment, causes said tamper indicating webs attaching said bridge to said cylindrical side wall of said fitment to break allowing removal of the bridge and plug. After removal of the tamper indicating bridge, the plug may be inserted back into the fitment for adequate sealing of the fitment and the container.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
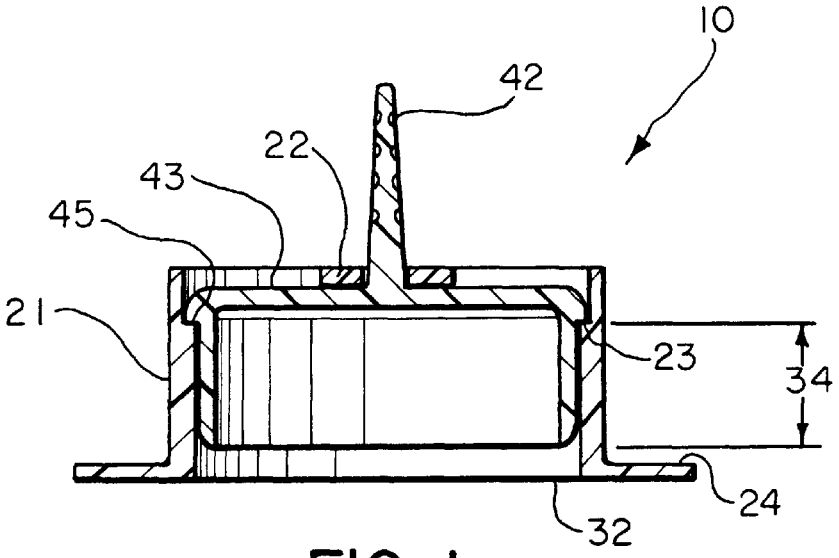
FIG. 1 is a side view of the assembled tamper indicating bridged fitment and plug of the present invention.
Figure 7:
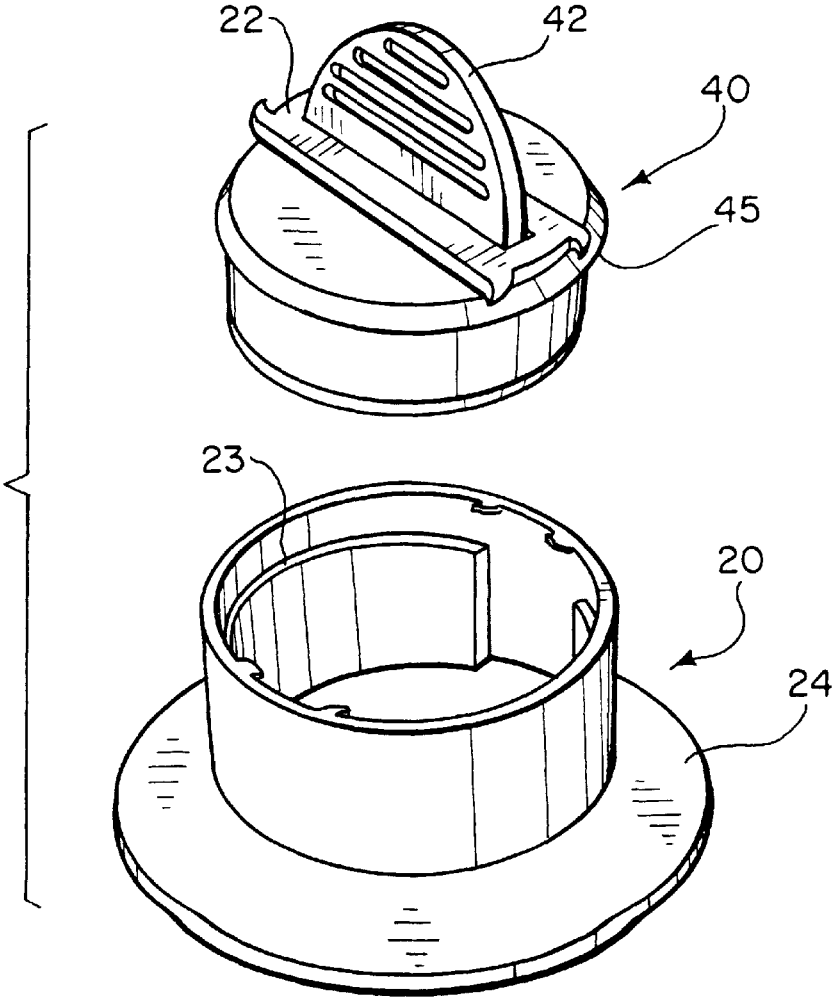
FIG. 7 is a perspective view of the tamper indicating bridged fitment of FIG. 1 after the tamper indicating webs have been broken.
Figure 4:
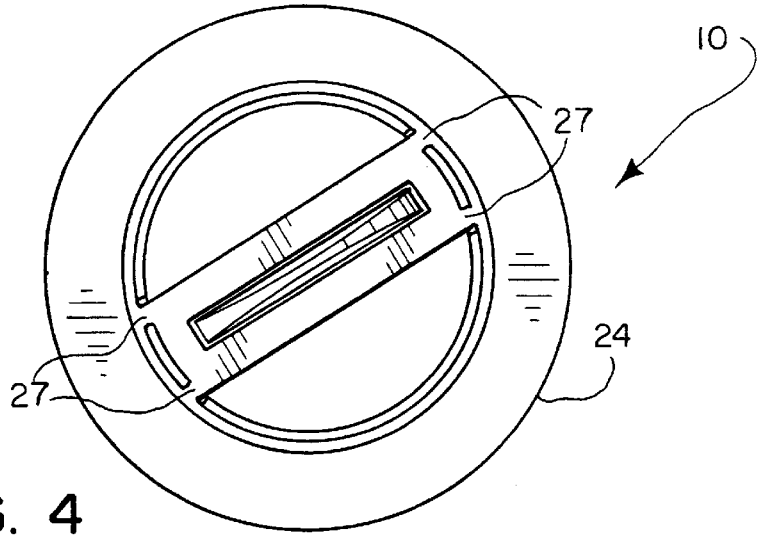
FIG. 4 is a top view of the bridged fitment of FIG. 1.

The tamper indicating bridged fitment with plug seal 10 is shown in FIG. 1. An annular flange 24 extends outward from the base of the fitment for application and welding to the interior wall of a container. Upwardly extending cylindrical side wall 21 forms the opening of the fitment through which material within the container passes. A bridge 22 extends across the top rim of cylindrical side wall 21 and is connected thereto by frangible tamper indicating webs 27 which are shown in FIG. 4. A slot 24, shown in FIG. 2, extends across tamper indicating bridge 22 in order to receive plug seal tab 47. Tamper indicating bridge 22 is connected to the top rim 25 of the cylindrical side wall by four frangible tamper indicating (TI) webs 27 which is clearly shown in FIG. 4. However, a single TI web on either side of the tamper indicating bridge 22 may also be utilized.

As shown in FIG. 1, tab 42 of the plug seal 40 extends upward from the combined fitment 10. It is thought that the plug seal, that is the top wall 43 and depending annular wall 44, would be made of a soft material, not hard plastic as the tab 42 and other fitment portions would comprised of. The plug portion or annular wall 44 can be made of low density polyethylene (LDPE) or other like pliable material and would therefore be able to bend slightly when reinserting the plug upward through the bottom of the fitment 20.

Figure 5:
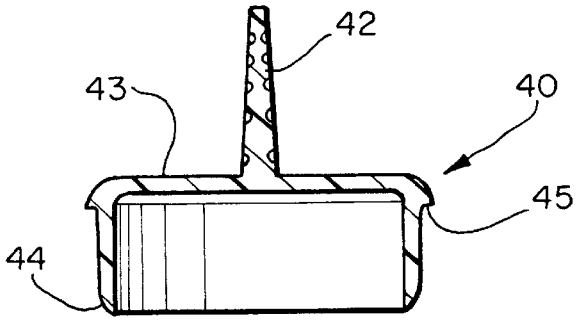
FIG. 5 is a side view of the plug seal of FIG. 1.

The fitment 20 and plug seal 40 are separate individual pieces which are assembled prior to application of the fitment to the container. As is shown in FIGS. 2 and 3, assembly of the tamper indicating bridged fitment 10 with plug seal 40 merely requires inserting the plug seal 40 upward through the bottom open end 32 of the fitment 20 such that tab 47 is inserted through slot 24. This would be possible since the plug seal portion of the plug, as indicated above, may be comprised of a soft material. As can be seen from FIG. 5, the plug has upwardly extending tab 42 which has ridges or knurlings thereon 47 for easy grasping by the user. Plug 40 has annular downwardly extending seal wall 44 and top wall 43, the diameter of said annular depending seal wall 44 being slightly larger than the diameter of lower portion 34 cylindrical side wall 21 of the fitment. Further, the bottom most edge of the downwardly extending wall 44 of plug 40 is slightly beveled as is shown in FIG. 3 in order to increase the ease of insertion of the plug 40 into the fitment 20. Bead 45 is provided on the plug to mate with step 23 of the fitment as is shown in FIG. 1 such that an adequate seal between the plug 40 and the fitment 20 is provided. Step 23 of fitment 20 prevents the plug from being over inserted in the fitment after removal of the tamper indicating bridge.

Figure 2A:
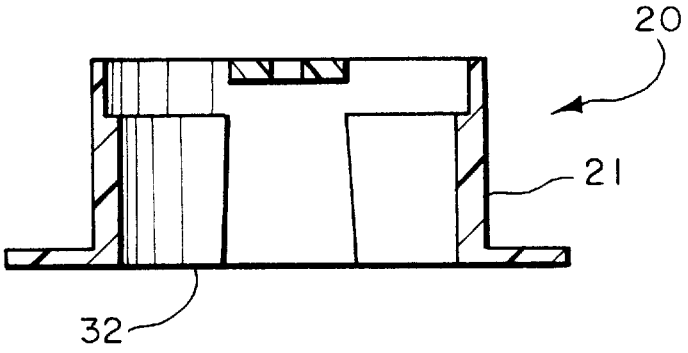
FIG. 2*a* is a side view of the bridged fitment of FIG. 1.
Figure 2:
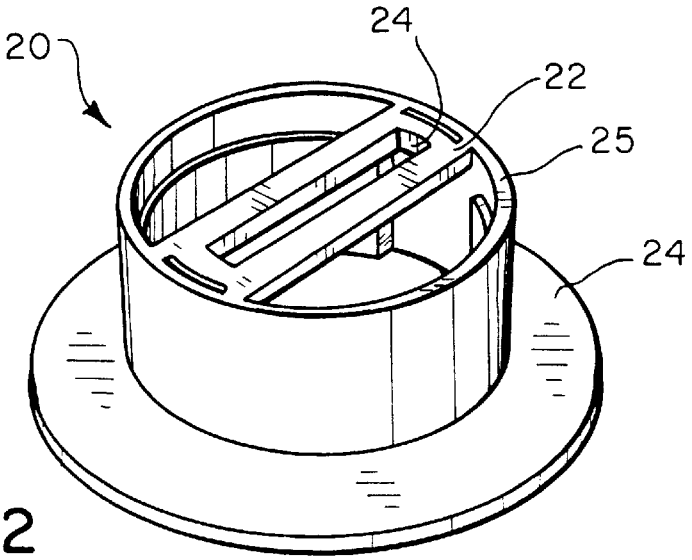
FIG. 2 is a top perspective view of the fitment of FIG. 1.
Figure 3:
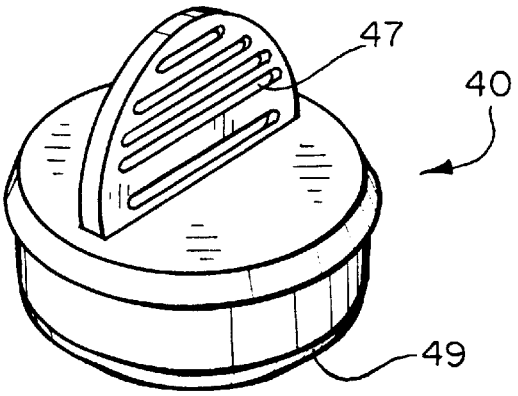
FIG. 3 is a top perspective view of the plug seal of FIG. 1.

As is shown in FIG. 2 and FIG. 2*a*, the fitment is comprised of annular flange 24, upwardly extending cylindrical side wall 21, step area 23, top rim 25, and bridge 22 which extends across the opening of the fitment. Bridge 22 has multiple contact points to the annular rim 25 of the fitment 20, said frangible contact points 27 breakable upon first removal of the plug from the fitment. Additionally, extending across the bridge 22 is slot 24 which receives tab 42 of the plug. Frangible bridges 27 are singular contact points of the rectangular bridge corners and are easily breakable therefrom. While a rectangular bridge is shown in this embodiment, it is realized that any desired shape of a bridge across the spout or top edge of fitment 20 may be utilized. Alternatively, singular frangible contact points may be made on either end of the tamper indicating bridge in order to ease removal of the bridge from the fitment 20.

As is shown in FIGS. 3 and 2, assembly of the tamper indicating bridged fitment with a sealing plug is relatively straight forward. The plug 40 with tab 47 extending upward therefrom is inserted into the underside opening 32 of fitment 20 such that tab 47 extends through slot 24 of bridge 22. Sufficient upward pressure on the plug 40 must be provided in order to have bead 45 of the plug snap into step 23 of the fitment as is shown in FIG. 2. As wall 44 may be comprised of some soft material, insertion of the plug 40 into the fitment 20 will not cause the bridge 22 to become dislodged from the fitment rim 25.

Figure 6:
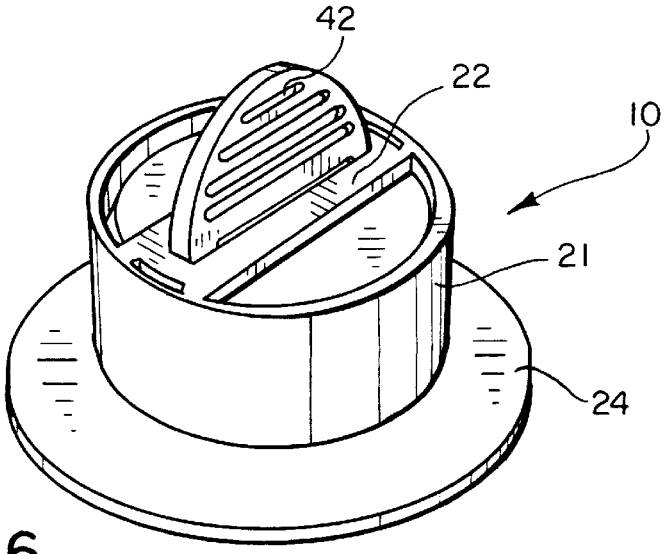
FIG. 6 is a perspective view of the assembled tamper indicating bridged fitment with plug seal of the present invention.

After assembly, as is shown in FIG. 6, the assembled tamper indicating bridged fitment with plug 10 is shown with the tab extending upward therefrom. Ideally, after assembly, the fitment 10 is assembled onto a container which is typically paperboard and which has a gabled top. However, alternative embodiment containers may be utilized for use with fitments and such use is well known in the art. Annular flange 24 of the fitment is welded to the container utilizing sonic welding or other suitable adhesive or welding means such that the combined fitment 10 is securely affixed to a container. The assembled fitment 10 is first inserted through the opening on the container such that cylindrical side wall or spout 21 extends outward therefrom and annular flange 24 remains on the interior of the container contacting the interior surface thereof. After assembly, sonic welding or other adhesive means is utilized to securely affix the annular flange 24 to the interior of the container. The assembled fitment 10 with the tab 42 outwardly extending therefrom is then shipped to the consumer. Upon first use, the consumer rotates tab 42 either in the clockwise or counter clockwise direction snapping the tamper indicating webs 27 on the bridge 22.

Upon first use of the fitment by the consumer, frangible webs 27 are fractured and the tamper indicating bridge is thereby removed. After removal of the bridge 22, the bridge may be removed from the plug 40. For reassembly of the plug 40 into the fitment 20, downward pressure is applied to the plug in order to insert the plug 40 into the interior of fitment 20 such that plug side wall 44 contacts the interior of cylindrical side wall 21 of the fitment 20. Since the diameter of the depending seal wall 44 of plug 40 is slightly larger than the interior diameter of cylindrical side wall 21 of the fitment, and due to the beveled edge 49 of the plug, plug 40 rests in the interior of the fitment 20 such that bead 23 and step 45 mate thereby provide an adequate seal for the fitment. Additionally, bead 45 and step 23 of the fitment prevent the over insertion of the plug in the fitment.

For continued use, easy removal of the plug from the fitment thereby simply requires upward force on tab 42 allowing contents of the container to flow through fitment 20. The plug 40 may remain in the fitment 20 after continued reinsertion therein by friction fit or interference between the depending wall 44 of fitment 40 and the interior of wall 21 of the fitment 20. This friction would be sufficient to prevent the plug from falling out of the fitment without upward pressure being applied. Alternatively, a small bead on the plug could possibly be added to properly fit the plug into a receiving bead formed on the interior of the fitment wall 21.

Figure 8:
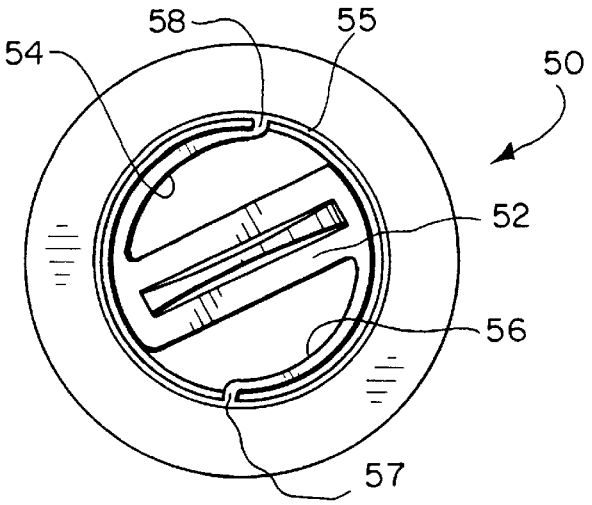
FIG. 8 is an alternative embodiment of a tamper indicating bridge of the present invention.
Figure 9:
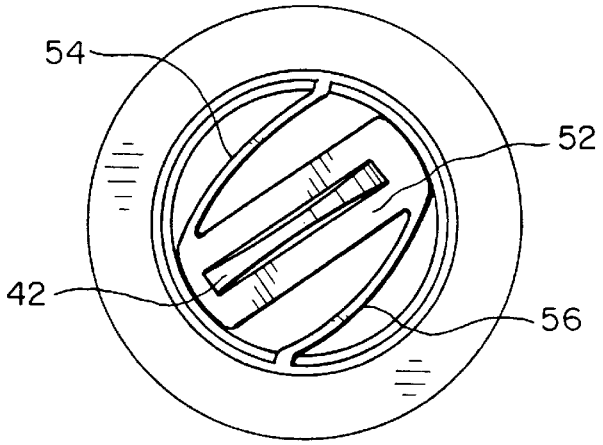
FIG. 9 is a top view of the alternative embodiment of FIG. 8 wherein the bridge has been rotated.
Figure 10:
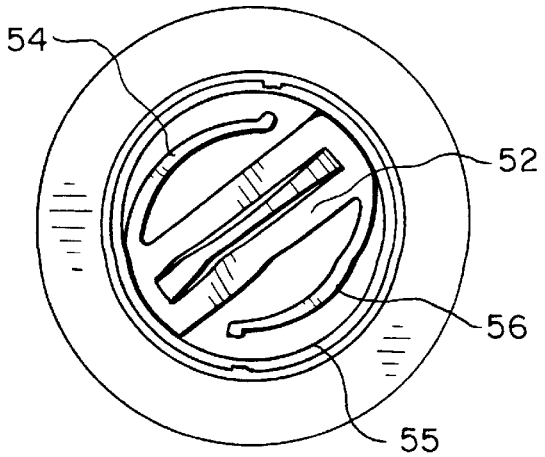
FIG. 10 is a top view of the alternative embodiment of FIG. 8 wherein the tamper indicating webs have been broken.

As shown in FIG. 8, an alternative embodiment of the tamper indicating bridged fitment 50 is shown. Two arms 54 and 56 spiral outwardly from bridge 52 and are attached to fitment side wall 55. Arms 54 and 56 spiral around bridge 52 such that the only point of contact of bridge 52 with fitment side wall 55 are frangible webs 57 and 58. Rotation of the bridge 52 by grasping tab 42 causes arms 54 and 56 to stretch as is shown in FIG. 9. After breaking frangible webs 57 and 58 by applying sufficient tension to the bridge via tab 42, the angle of the arms 54 and 56 is reduced as is shown in FIG. 10 thereby providing a large gap between arms 54 and 56 and side wall 55. This provides a clear indication that the tamper indicating bridge 52 of the fitment 50 has been broken.

The fitment 20 may be manufactured of a simple thermoplastic resin which is found in standard injection molding techniques. Additional materials of manufacture are well within the ability of one of ordinary skill and the art and any alternative use of material for the tamper indicating bridged fitment shown herein falls within the scope of this invention.

The foregoing detailed description is given primarily for clearness of understanding and no unnecessary limitations are to be understood therefrom for modifications will become obvious to those skilled in the art upon reading this disclosure and may be made without departing from the spirit of the invention of the scope of the appended claims.

What is claimed is:

1. A tamper indicating fitment, comprising:

a cylindrical side wall having an annular flange extending outward from a first distal end;

a bridge extending across the edge of the opposite distal end of said side wall and having a slot; and, a plug, said plug having a tab extending upward through said slot on said bridge.

2. The fitment of claim 1 wherein said bridge is a rectangular bridge and is connected to said side wall by a plurality of frangible webs.

3. The fitment of claim 2 wherein said plurality of frangible webs is further comprised of four frangible webs, one at each corner of said bridge.

4. The fitment of claim 1 wherein said cylindrical side wall has a step on the interior of said side wall, said side wall having a diameter which is greater above said step then below said step.

5. The fitment of claim 1 wherein said plug has a top wall, said tap extending upwardly from said top wall, and further wherein said plug has a depending seal wall.

6. The fitment of claim 5 wherein said plug is retained within the interior of said cylindrical side wall by a bead, said bead comprised of the juncture of said top wall and said depending seal wall, said depending seal wall having a diameter that is less than the diameter of said top wall, said depending seal wall extending down into the interior of said fitment cylindrical side wall.

7. The fitment of claim 1 wherein said plug and said cylindrical side wall is comprised of a thermoplastic material.

8. The fitment of claim 1 wherein said plug has a depending annular wall, said depending annular wall comprised of LDPE.

9. A two piece tamper indicating fitment, comprising:

a spout having an upwardly extending cylindrical sidewall and an annular flange extending outward from the base of said sidewall;

said spout having a top edge and having a bridge extending across said top edge, said bridge connected to said top edge by a plurality of frangible webs, said bridge having a longitudinally extending slot formed therein;

a plug, said plug having a top wall, a tab extending upwardly from said top wall and an annular depending seal wall;

wherein said tab extends upward through said slot on said bridge.

10. The fitment of claim 9 wherein said spout has an interior surface, said interior surface having an upper portion and a lower portion, said upper portion having a diameter which is greater then the diameter of said lower portion, said upper portion and said lower portion separated by an upwardly facing annular rim.

11. The fitment of claim 10 wherein said top wall of said plug has a diameter which is greater then the diameter of said depending seal wall.

12. The fitment of claim 11 wherein said plug further has a downwardly facing annular rim formed between said top wall and said depending seal wall.

13. The fitment of claim 12 wherein said downwardly facing annular rim of said plug mates with upwardly facing annular rim on said spout to adequately seal said spout with said plug.

14. The fitment of claim 9 wherein said bridge is rectangular.

15. The fitment of claim 14 wherein said plurality of frangible webs are four webs connecting said bridge to said edge.

16. The fitment of claim 9 wherein said plug and said spout are made of a thermoplastic material.

17. A tamper indicating fitment, comprising:

a fitment having an annular flange and having an upwardly extending cylindrical side wall, said side wall extending to an upper edge;

a bridge extending across said edge of said cylindrical side wall and connected thereto by frangible webs;

a plug having a top wall and a downwardly extending cylindrical sealing wall, and additionally having a tab extending upward from said top wall;

wherein said bridge has a slot formed therein and wherein said tab of said pug extends upward through said slot.

* * * * *

UNITED STATES PATENT AND TRADEMARK OFFICE

CERTIFICATE OF CORRECTION

PATENT NO. : 6,000,566

DATED : December 14, 1999

INVENTOR(S) : Eric W. Kost

It is certified that error appears in the above-identified patent and that said Letters Patent is hereby corrected as shown below:

Col. 2, line 59, add --be-- between "would" and "of";
Claim 10, col.6, line 2 - change "then" to --than--;
Claim 11, col.6, line 6 - change "then" to --than--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*